US010837196B2

(12) United States Patent
Cowan

(10) Patent No.: US 10,837,196 B2
(45) Date of Patent: Nov. 17, 2020

(54) APPARATUS AND METHOD FOR DISPENSING AND TENSIONING FENCE WIRE

(71) Applicant: William Quentin Cowan, 100 Mile House (CA)

(72) Inventor: William Quentin Cowan, 100 Mile House (CA)

( * ) Notice: Subject to any disclaimer, the term of this patent is extended or adjusted under 35 U.S.C. 154(b) by 0 days.

(21) Appl. No.: 16/234,288

(22) Filed: Dec. 27, 2018

(65) Prior Publication Data

US 2020/0208433 A1 Jul. 2, 2020

(51) Int. Cl.

| | |
|---|---|
| ***E04H 17/26*** | (2006.01) |
| ***E04H 17/04*** | (2006.01) |
| ***B65H 59/00*** | (2006.01) |
| ***B65H 49/26*** | (2006.01) |

(52) U.S. Cl.

CPC ..... *E04H 17/266* (2013.01); *B65H 49/26* (2013.01); *B65H 59/00* (2013.01); *E04H 17/04* (2013.01); *B65H 2701/364* (2013.01)

(58) Field of Classification Search

CPC .. B65H 49/26; B65H 59/00; B65H 2704/364; E04H 17/266; E04H 17/04

See application file for complete search history.

(56) References Cited

U.S. PATENT DOCUMENTS 3,650,492 A 3/1972 Stum
3,934,655 A * 1/1976 Whistle ..... B65H 49/32 173/46
5,582,216 A 12/1996 Smith et al.
5,632,470 A * 5/1997 Leland ..... E04H 17/266 242/557
5,806,779 A * 9/1998 Crum ..... E04H 17/266 242/399.1
6,042,046 A 3/2000 Beyer, Sr.
6,283,454 B1 9/2001 Bricker
6,860,471 B2 3/2005 Albritton
7,011,269 B1 * 3/2006 Chouinard ..... B65H 49/32 242/403

(Continued)

FOREIGN PATENT DOCUMENTS

WO 2009025679 2/2009

*Primary Examiner* — William A. Rivera
(74) *Attorney, Agent, or Firm* — Richard D. Okimaw

(57) ABSTRACT

An apparatus and method for dispensing and tensioning fence wire, the apparatus comprising a support frame extending along a longitudinal length between a front and a rear, the frame adapted to be moved along a path proximate to the fence to be formed and a rotational support adapted to rotatably support at least one reel of fence wire thereon, an adjustable tensioning unit adapted to be selectively secured to a fence wire and a drive unit wherein the drive unit is adapted to selectively control the tensioning unit to apply tension to the fence wire. The method comprising rotatably supporting at least one reel of fence wire on a rotational support, securing a first end of the fence wire to one of a plurality of fence posts and moving the frame along a path proximate to the fence to be formed, dispensing the fence wire along the path. Securing an adjustable tensioning unit to a second end of the fence wire, selectively controlling the tensioning unit to apply tension to the fence wire and securing a second end of the fence wire to one of the plurality of fence posts.

20 Claims, 10 Drawing Sheets

(56) References Cited

U.S. PATENT DOCUMENTS

| | | | | |
|---|---|---|---|---|
| 7,195,193 | B2 * | 3/2007 | Capps | E04H 17/266 242/396.5 |
| 8,104,160 | B2 | 1/2012 | Wohlgemuth | |
| 2004/0065767 | A1 * | 4/2004 | Parker | A01K 3/00 242/557 |
| 2004/0065768 | A1 | 4/2004 | Parker | |
| 2004/0227031 | A1 * | 11/2004 | Yoder | B65H 16/103 242/390.5 |
| 2005/0133776 | A1 * | 6/2005 | Capps | E04H 17/266 256/32 |
| 2008/0258003 | A1 * | 10/2008 | Foster | B65H 49/32 242/611 |
| 2009/0014578 | A1 * | 1/2009 | Beem | E04H 17/266 242/557 |
| 2011/0121125 | A1 * | 5/2011 | Stow | B66D 1/36 242/557 |
| 2018/0044868 | A1 * | 2/2018 | Miller | E04H 17/00 |

* cited by examiner

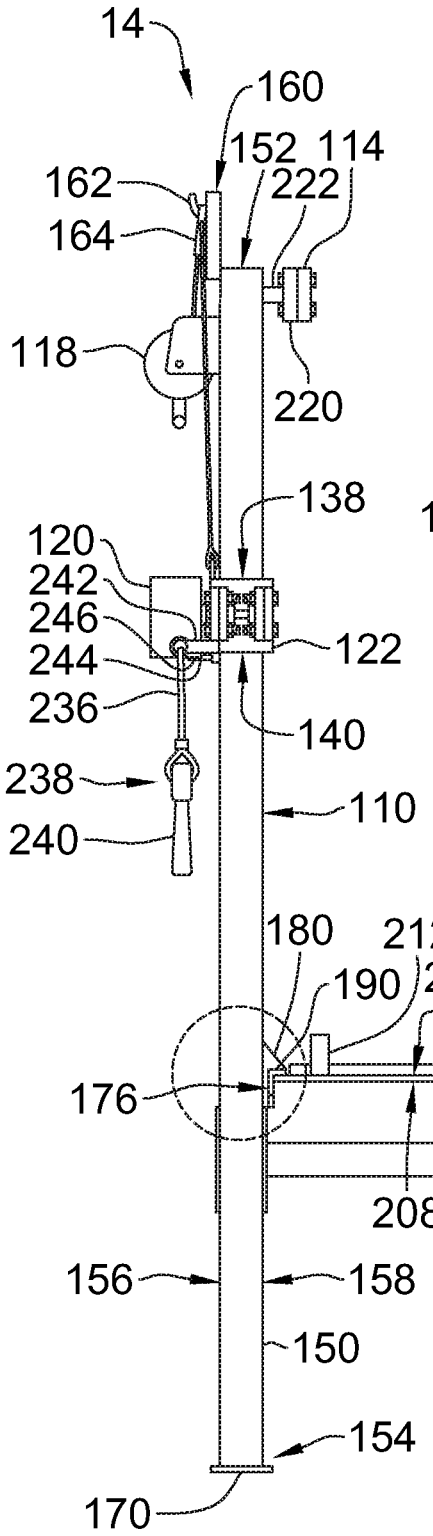
Figure 8
Figure 9
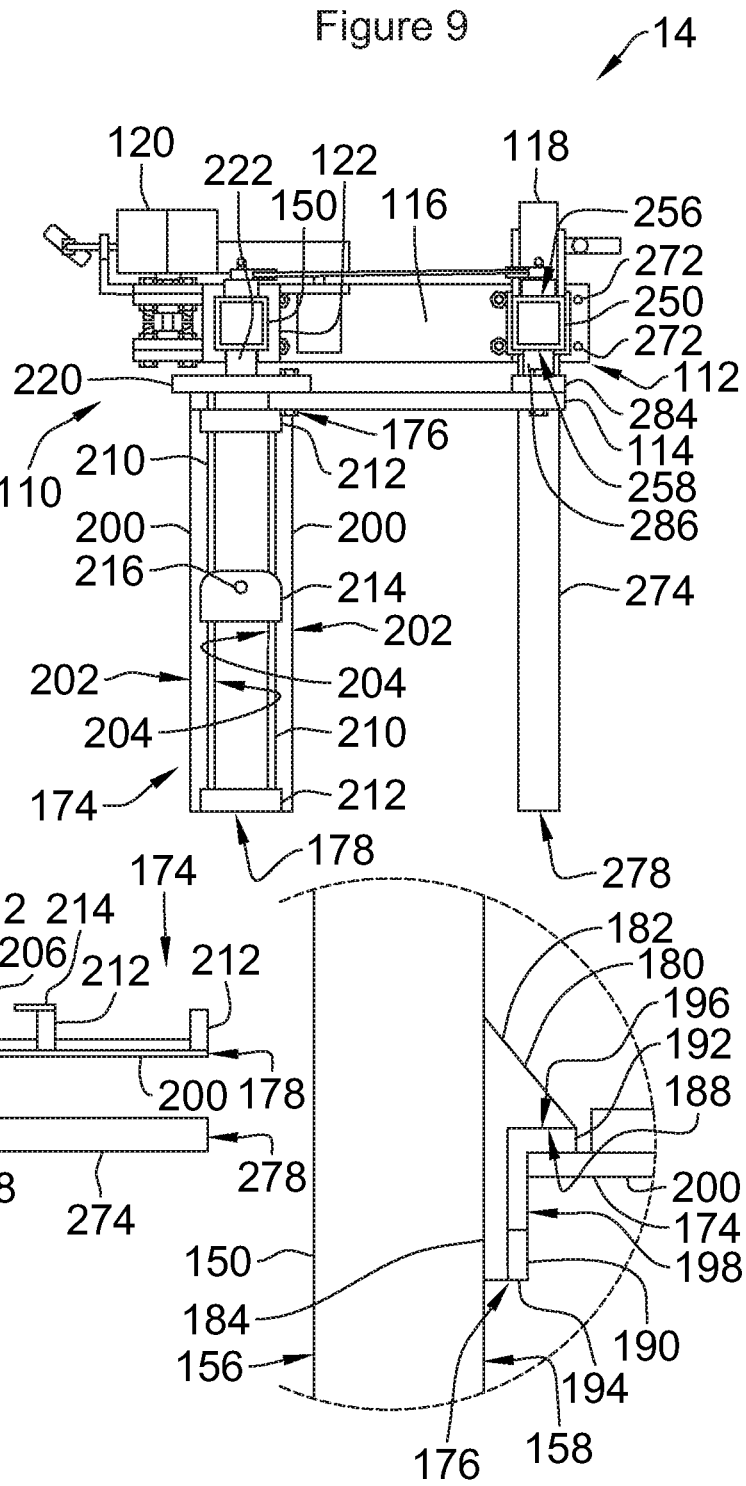
Figure 10

APPARATUS AND METHOD FOR DISPENSING AND TENSIONING FENCE WIRE

BACKGROUND OF THE INVENTION

1. Field of Invention

The present invention relates generally to fencing and in particular to an apparatus and method for dispensing and tensioning fence wire.

2. Description of Related Art

In the agriculture industry, it is common to utilize wire fences to separate property. To create a wire fence, a plurality of individual strands of fence wire are secured to a series of fence posts.

Fence wire is typically supplied on drum rolls or reels and is rolled off of the drum by rotating the drum and laying the wire on the ground next to the intended fence location. The wire may be laid out one strand at a time, or several rolls may be supported on a common shaft or rod and unrolled simultaneously.

Barbed wire fences are constructed by securing the first end of a bottom wire to a first end post, then tensioning the wire at the second end and securing it to a second end post. Finally, the wire is stapled to the line posts between the two end posts. This process is repeated for each wire on the fence, ending with the bottom wire. It will be appreciated that such a conventional process is time consuming and may lead to inconsistency in wire tension.

Some devices are known in the prior art where multiple strands of fence wire are dispensed simultaneously. U.S. Pat. No. 5,582,216 to Smith et al. describes an apparatus and method for dispensing a plurality of wires simultaneously from an upstanding support spindle. Disadvantageously, the wires are positioned to dispense from a frame positioned between two wheels, such that the tensioning of wires is performed at an offset distance from the fence posts. A separate tensioning device is not utilized, relying on the towing vehicle (such as a tractor) to provide the force for tensioning the wires; in some terrain, this method is not practical, and moving an entire vehicle to tension the wires does not permit the operator to perform precise tension adjustments. Additionally, if the wires have not been properly secured to an end fence post prior to dispensing, the nature of a vertical dispensing unit will result in a tangling of wires.

SUMMARY OF THE INVENTION

According to a first embodiment of the present invention there is disclosed an apparatus for dispensing and tensioning fence wire, the apparatus comprising a support frame extending along a longitudinal length between a front and a rear, the frame adapted to be moved along a path proximate to the fence to be formed and a rotational support adapted to rotatably support at least one reel of fence wire thereon. The apparatus further comprises an adjustable tensioning unit adapted to be selectively secured to a fence wire and a drive unit wherein the drive unit is adapted to selectively control the tensioning unit to apply tension to the fence wire.

The rotational support may include an elongate shaft extending between distal ends, the elongate shaft adapted to receive at least one reel of fence wire thereon. The rotational support may be rotatably secured to the frame at a pivot. The rotational support may be selectively pivotable about the pivot between a raised position and a lowered position. The apparatus may further comprise an actuator operable to raise and lower the rotational support. The actuator may be operably connected to the drive unit.

The tensioning unit may be selectably mountable on one of a first or second side of the support frame. The tensioning unit may include a linear actuator operable to selectively position the tensioning unit along a path transverse to the longitudinal length of the frame. The linear actuator may be operably connected to the drive unit.

The tensioning unit may include a vertical support having a plurality of bores vertically spaced apart therethrough. The apparatus may further comprise a head having a tensioning winch and motor secured thereto, the head may be slideably supported on the vertical support. The apparatus may further comprise a head support adapted to be slideably received within any of the plurality of bores, wherein the head may engage upon the head support to be retained at a vertical position on the vertical support corresponding to the head support.

The tensioning winch may be driven by the motor. The tensioning winch may support a cable having a first end attached to the tensioning winch and a second end attached to a fastener. The fastener may be adapted to selectively secure the fence wire thereto. The motor may rotate the tensioning winch to apply tension to the fence wire secured to the fastener. The motor may be operably connected to the drive unit.

According to a further embodiment of the present invention there is disclosed a method for dispensing and tensioning fence wire, the method comprising rotatably supporting at least one reel of fence wire on a rotational support extending from a rear of a support frame, securing a first end of the fence wire to one of a plurality of fence posts and moving the frame along a path proximate to the fence to be formed, dispensing the fence wire along the path. The method further comprises securing an adjustable tensioning unit to a second end of the fence wire, with the tensioning unit extending from a side of the support frame, selectively controlling the tensioning unit with a drive unit to apply tension to the fence wire, and securing a second end of the fence wire to one of the plurality of fence posts.

The method may further comprise horizontally adjusting a position of the fence wire relative to the plurality of fence posts by adjusting a horizontal position of the tensioning unit relative to the side of the frame with an actuator operably connected to the drive unit.

The method may further comprise vertically adjusting a height of the fence wire adjacent to the plurality of fence posts by adjusting a vertical position of a tensioning winch on the tensioning unit.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

FIG. 8 is a side view of the tensioning unit.

FIG. 9 is a top view of the tensioning unit.

FIG. 10 is a detailed side view of the track attachment to the vertical support.

DETAILED DESCRIPTION

Figure 1:
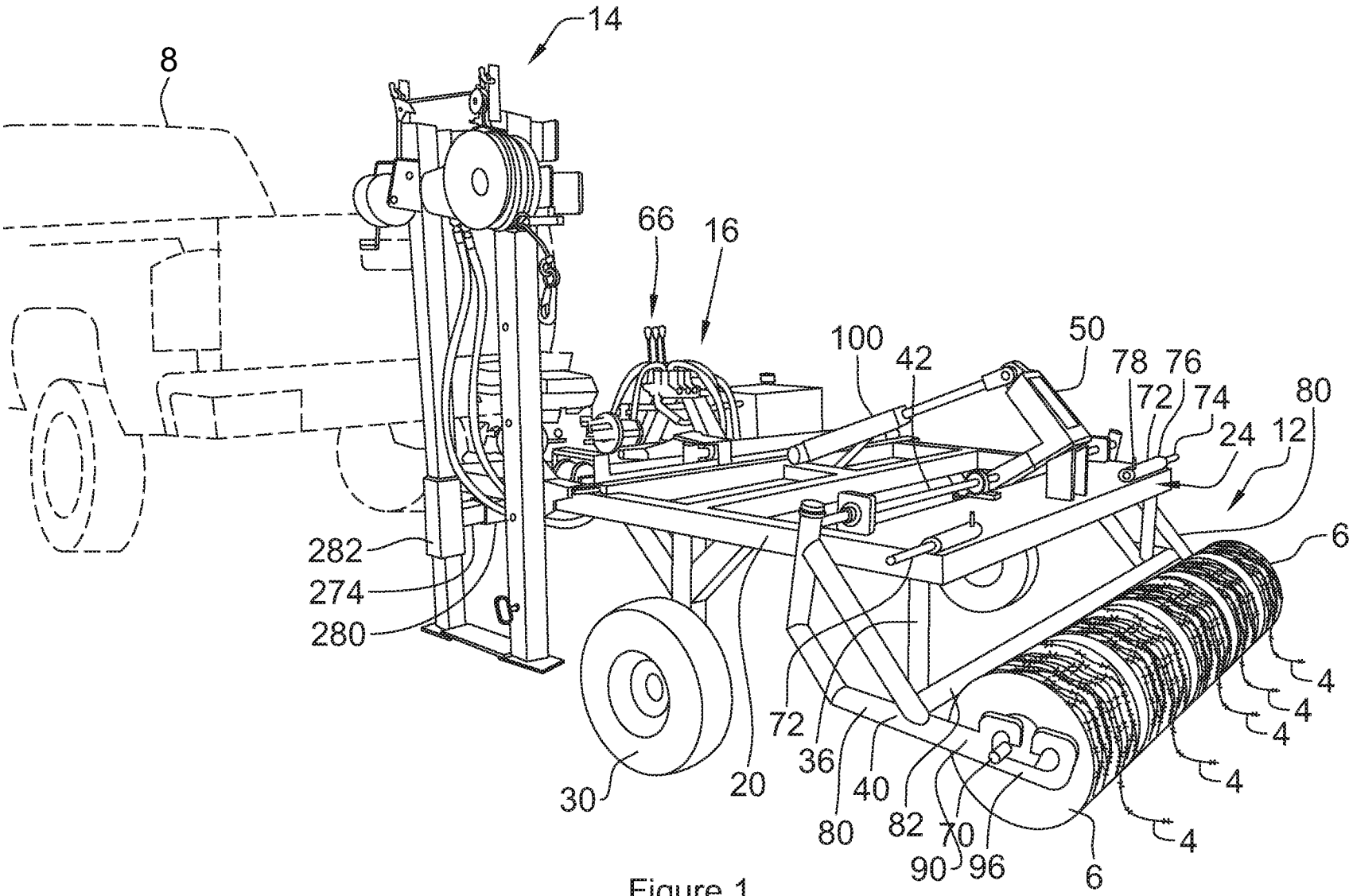
FIG. 1 is a perspective view of an apparatus for dispensing and tensioning fence wire according to a first embodiment of the invention.

Referring to FIG. 1, an apparatus for dispensing and tensioning fence wire according to a first embodiment of the invention is shown generally at 10, coupled to a vehicle 8, such as a pickup truck, tractor or all-terrain vehicle (ATV). The apparatus 10 supports a plurality of fence wire reels 6 on a reel support 12. Fence wire 4 may be dispensed therefrom and tensioned with a tensioning unit 14, to facilitate the installation of a wire fence system, as will be set out below.

Figure 2:
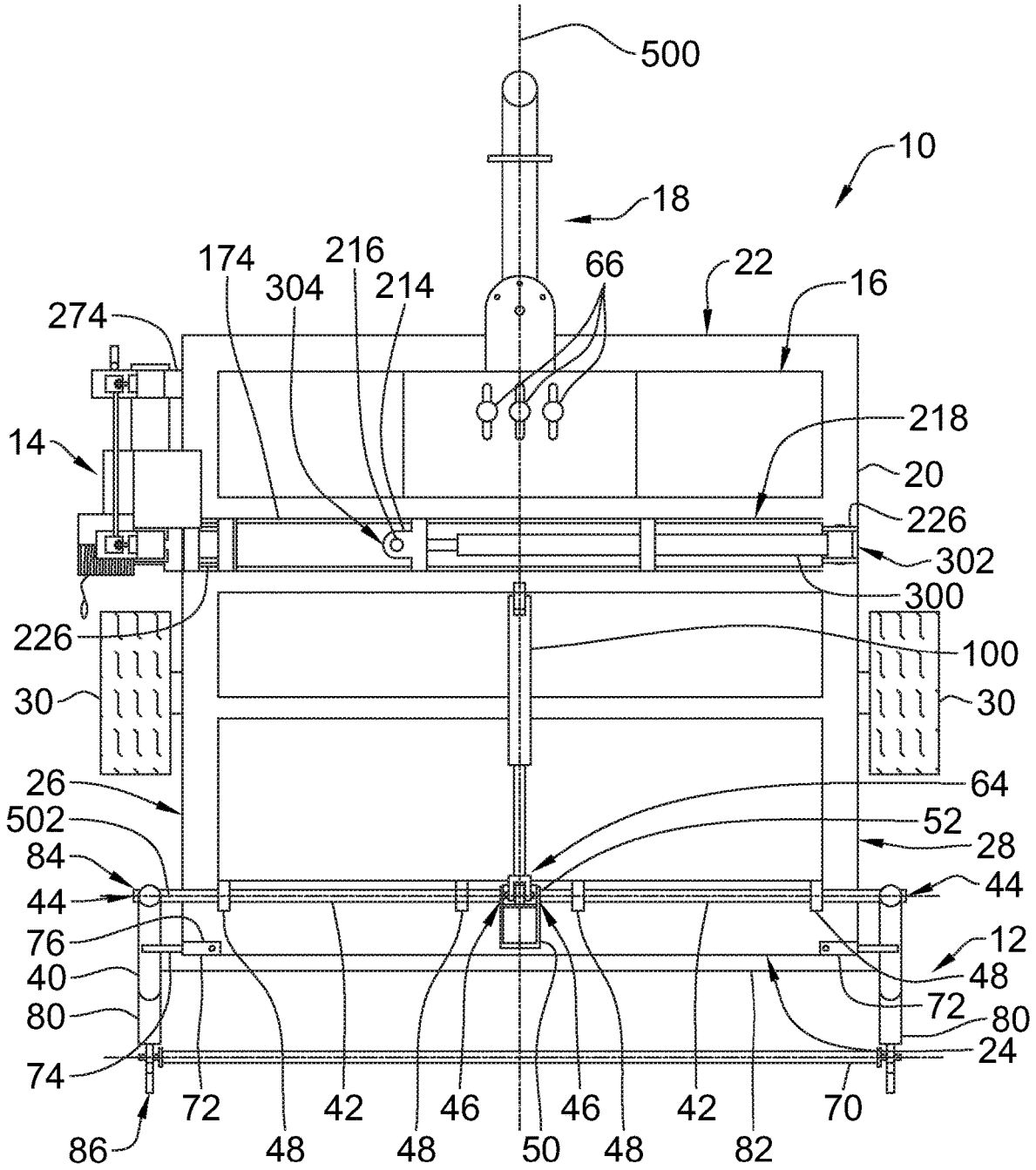
FIG. 2 is a top view of the apparatus of FIG. 1 with the tensioning unit in a retracted position.
Figure 4:
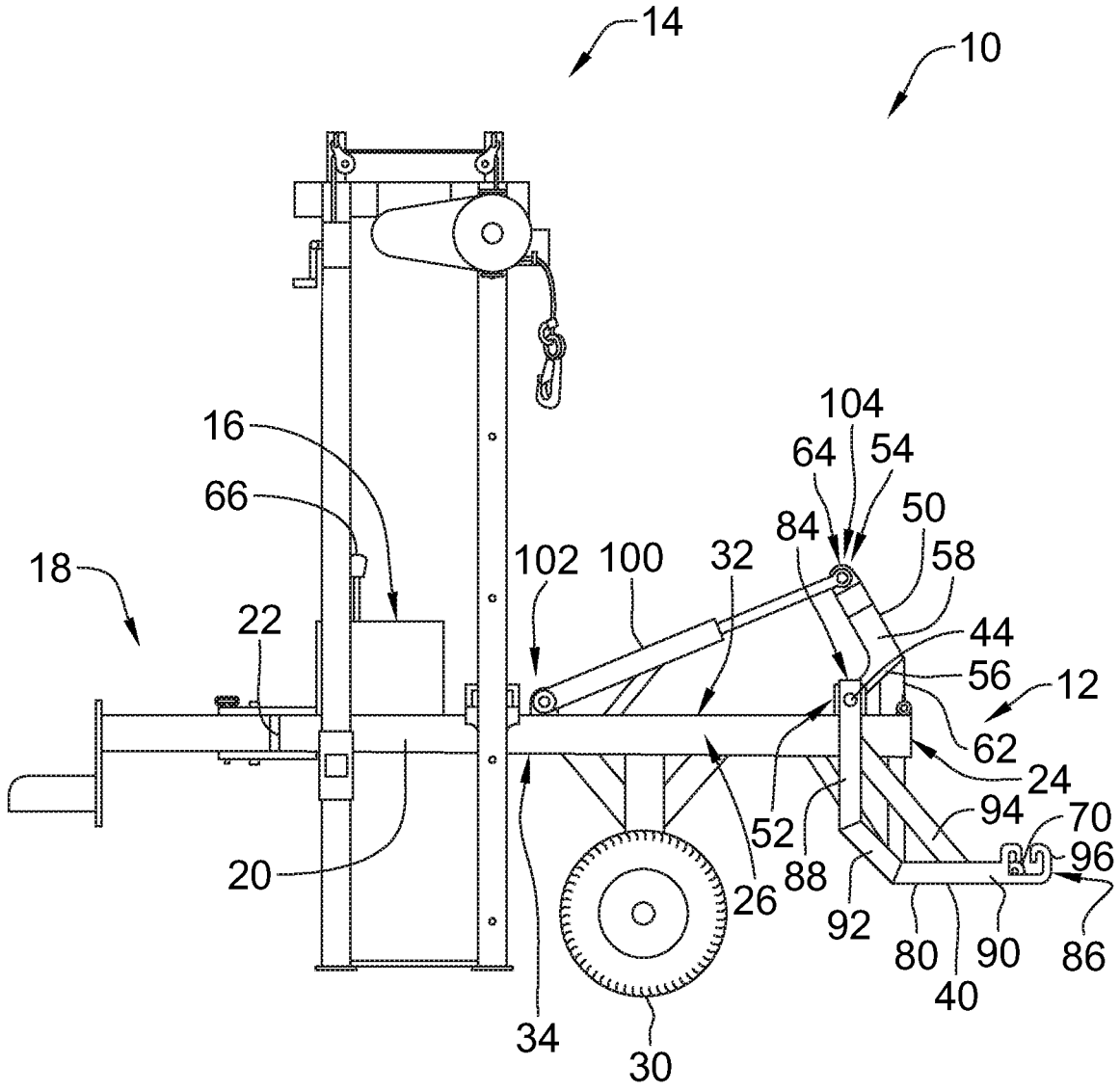
FIG. 4 is a side view of the apparatus of FIG. 1 with the rotational support in a lowered position and the tensioning winch at $5^{th}$ wire position.

Referring to FIGS. 1, 2 and 4, the apparatus 10 includes a support frame 20 extending longitudinally along a plane 500 between front and rear ends, 22 and 24, respectively, and between first and second sides, 26 and 28, respectively, and having top and bottom surfaces, 32 and 34, respectively. The support frame 20 is conventionally supported on a pair of wheels 30, which may be mounted on a common axle or stub axles, as is commonly known. The reel support 12 is rotationally fixed to the support frame 20 proximate to the rear end 24. The tensioning unit 14 is slideably mounted to the support frame 20 on one side thereof proximate to the front end 22. As illustrated, the tensioning unit 14 is slideably mounted to the first side 26, although it will be appreciated that the tensioning unit 14 may be removed from the first side 26 and thereafter slideably mounted to the second side 28 to permit tensioning of fence wire 4 on a fence located to either side of the support frame 20. A drive unit 16 is mounted to the top surface 32 of the support frame 20 proximate to the front end 22. The drive unit 16 is operably connected to the reel support 12 and tensioning unit 14, as will be set out further below, and is controlled by a set of controls 66. An adjustable hitch coupler 18, as is commonly known, extends from the front end 22 of the support frame 20 to allow hookup to a vehicle hitch by conventional methods.

The reel support 12 supports a removable reel support rod 70 on a rotational support frame 40. The rotational support frame 40 is pivotably mounted to the top surface 32 of the support frame 20 along a pivot axis 502. The drive unit 16 controls a linear actuator 100 extending along the plane 500 from the support frame 20 to rotate the rotational support frame 40 about the pivot axis 502 with a crank 50 therebetween. The linear actuator 100 is operable to raise and lower the reel support rod 70, as will be set out further below.

Figure 5:
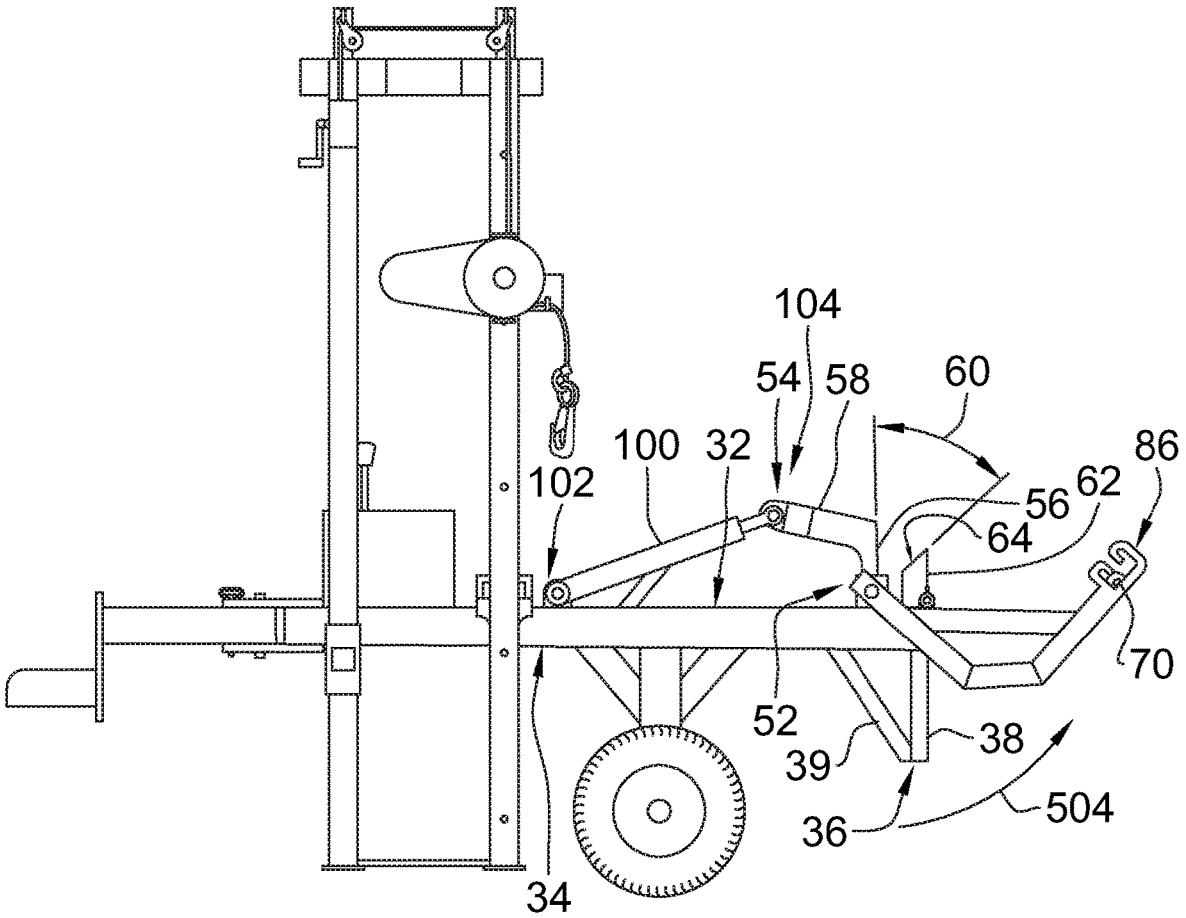
FIG. 5 is a side view of the apparatus of FIG. 1 with the rotational support in a raised position and the tension winch at $4^{th}$ wire position.

The rotational support frame 40 includes two vertical side members 80 with a horizontal member 82 therebetween, as best illustrated in FIGS. 1 and 2. Each side member 80 extends between a pivot end 84 and a support end 86, as best illustrated in FIG. 4. A pivot portion 88 extends from the pivot end 84 and a support portion 90 extends from the support end 86 with a joint portion 92 therebetween. The joint portion 92 is configured to position the pivot portion 88 and the support portion 90 with a right angle therebetween. A cross brace 94 extends between the pivot portion 88 and the support portion 90 to provide structural reinforcement, as is commonly known. The support portion 90 includes a U-bracket 96 at the support end 86, adapted to receive and retain a distal end of the reel support rod 70 therein, as is commonly known. The horizontal member 82 extends between the support portions 90 of the two side members 80 and is sized to position the side members 80 such that they are spaced apart from the first and second sides 26 and 28 of the support frame 20. The horizontal member 82 is configured to engage upon a pair of stoppers 36 extending from the bottom surface 34 of the support frame 20 at the first and second sides 26 and 28 proximate to the rear end 24 when the reel support 12 is in a lowered position, as illustrated in FIGS. 1 and 4. As illustrated in FIG. 5, the stoppers 36 are formed with a vertical portion 38 and a cross brace portion 39, as is commonly known in the art.

Referring to FIGS. 1 and 2, the rotational support frame 40 is pivotably mounted to the top surface 32 of the support frame 20 with a pair of horizontal rods 42 extending from a pivot 44 proximate to the pivot end 84 of the side members 80 to distal ends 46 along the pivot axis 502. The horizontal rods 42 are rotationally supported by a plurality of bearings 48 and are secured to the crank 50 at the distal ends 46.

Referring now to FIGS. 4 and 5, the crank 50 extends between a crank end 52 and a pivot end 54. A base portion 56 extends from the crank end 52 and a pivot portion 58 extends from the pivot end 54. The base portion 56 and pivot portion 58 are formed with an angle 60 therebetween. A crank stopper 62 with a top surface 64 extends from the top surface 32 of the support frame 20 proximate to the rear end 24. The top surface 64 of the crank stopper 62 is adapted to receive the base portion 56 thereon when the linear actuator 100 is fully extended, as illustrated in FIG. 4, at the lowered position of the reel support 12.

The linear actuator 100 extends between first and second ends, 102 and 104, respectively, along the longitudinal plane 500. The linear actuator 100 is pivotably mounted to the top surface 32 of the support frame 20 at the first end 102 and pivotably mounted to the pivot end 54 of the crank 50 at the second end 104. The linear actuator 100 is operably connected to the drive unit 16. The drive unit 16 supplies hydraulic fluid to the linear actuator 100, as is commonly known, and may be selectively controlled by an operator. It will be appreciated that, for clarity, hydraulic connections extending from the drive unit 16 are not illustrated throughout.

At the extended position of the linear actuator 100, as illustrated in FIG. 4, the crank 50 engages upon the crank stopper 62 and the horizontal member 82 engages upon the stoppers 36. As the linear actuator 100 is retracted, drawing the second end 104 towards the first end 102, the pivot end 54 of the crank is moved with the second end 104 of the actuator 100, rotating the crank end 52 about the pivot axis 502 and lifting the base portion 56 away from the crank stopper 62. As the crank end 52 is rotated, the attached horizontal rods 42 are rotated about the pivot axis 502 within the bearings 48. As the horizontal rods 42 are rotated about the pivot axis 502, the attached side members 80 are rotated, raising the support end 86 with the retained reel support rod 70 thereon upwards in a direction generally indicated at 504. Referring to FIGS. 1, 2 and 5, a pair of extendable side stoppers 72 are secured to the top surface 32 of the support frame 20 at the rear end 24 and are oriented to extend transverse to the longitudinal plane 500 away from the first and second sides 26 and 28. Each side stopper 72 may be formed using a rod 74 operable to slide within a sleeve 76 and retained at a selected position with a set screw 78, as is commonly known. With the side stoppers 72 extended, as illustrated in FIGS. 1, 2 and 5, the side members 80 engage upon the rods 74 at the raised position, thus preventing further rotation of the rotational support frame 40. It will be appreciated that the rotational support frame 40 may be further rotated with the rods 74 of the side stoppers 72 in a retracted position.

As set out above, the tensioning unit 14 is slideably mounted to either the first or second side, 26 or 28, respectively, of the support frame 20. Turning now to FIGS. 6 through 9, the tensioning unit 14 includes a head support frame 110 and a lift support frame 112 selectively joined with upper and lower brackets, 114 and 116, respectively. A lift winch 118 is mounted on the lift support frame 112 and a head unit 120 is slideably mounted on the head support frame 110. The lift winch 118 is operably connected to the head unit 120 to raise and lower the head unit 120 on the head support frame 110, as will be set out below.

Figures 6, 7:
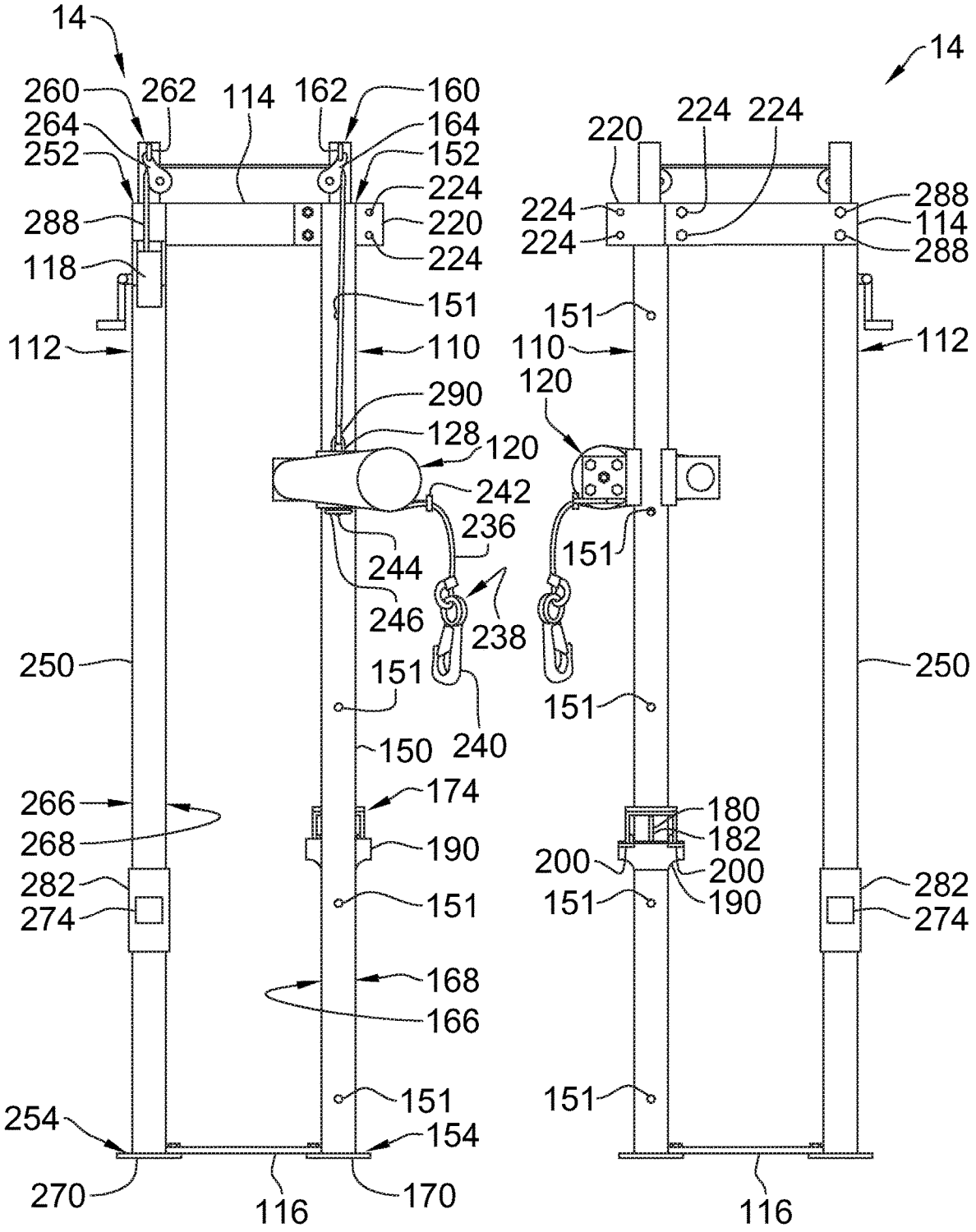
FIG. 6 is a front view of the tensioning unit.
FIG. 7 is a rear view of the tensioning unit.

Referring to FIGS. 6 and 8, the head support frame 110 includes an elongate vertical support 150 having a generally square cross section extending between upper and lower ends 152 and 154, respectively, with front and rear surfaces, 156 and 158, respectively and first and second sides 166 and 168, respectively. A plurality of spaced apart bores 151 extend through the vertical support 150 between the front and rear surfaces 156 and 158, the purpose of which will be set out below. A head pulley support 160 is fixed to the front surface 156 and extends from the upper end 152 with a hook 162 thereon supporting a head pulley 164. The lower end 154 is fixed to a base member 170 having two pairs of mounting holes 172 extending vertically therethrough to either side 166 and 168 of the vertical support 150, to permit assembly of the tensioning unit 14 for installation on either the first or second side, 26 or 28, of the support frame 20, as will be set out below.

A track 174 extends transverse to the rear surface 158 of the vertical support 150 between proximate and distal ends, 176 and 178, respectively, spaced apart from the rear surface 158 by a head spacer bracket 180, as best illustrated in FIGS. 7, 8 and 10, by a distance sufficient to permit the head unit 120 to pass thereby, as will be set out below. As illustrated in FIG. 7, the head spacer bracket 180 is planar with a narrow width, such as, by way of non-limiting example, ¼" to ½" wide (6 mm to 13 mm) to permit the head unit 120 to pass thereby, as will be set out below. Referring now to FIG. 10, the head spacer bracket 180 is formed with a triangular upper portion 182 and a rectangular lower portion 184 having a common rear surface 186 fixed to the rear surface 158 of the vertical support 150. The head spacer bracket 180 includes a right-angle track mount surface 188 formed on the lower edge of the triangular upper portion 182 and the outer edge of the rectangular lower portion 184.

Figure 3:
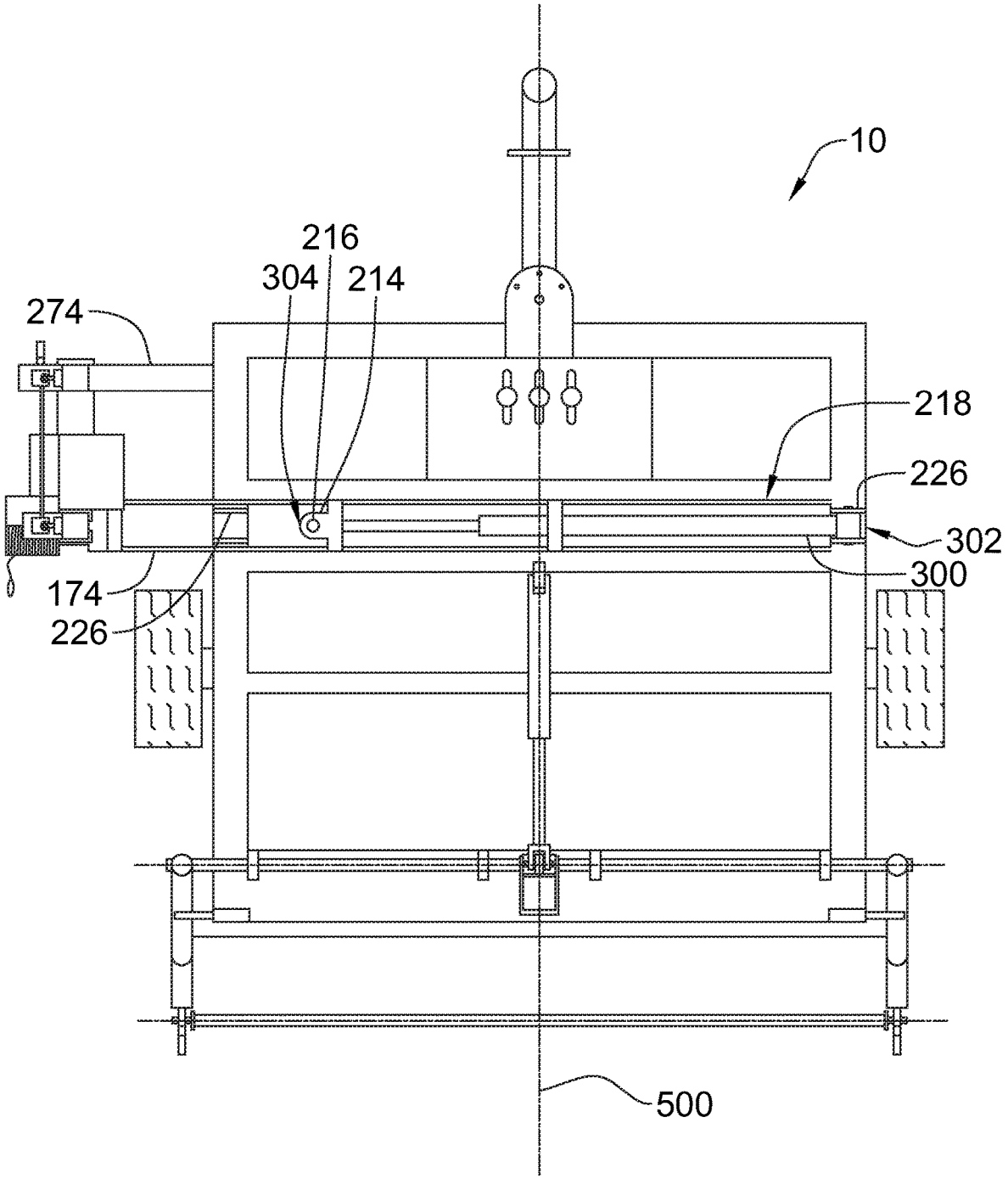
FIG. 3 is a top view of the apparatus of FIG. 1 with the tensioning unit in an extended position.

The track 174 includes a track bracket 190 at the proximate end 176 with a pair of elongate planar track base members 200 extending between the track bracket 190 and the distal end 178 with outer and inner edges 202 and 204, respectively, and top and bottom surfaces 206 and 208, respectively, as illustrated on FIGS. 8 and 9. An upright track wall 210 extends along the top surface 206 of each track base member 200 proximate to the inner edge 204. The track may include a plurality of cross braces 212, as are commonly known, extending between the two track base members 200 to maintain consistent spacing therebetween. An actuator mount 214 is secured to one cross brace 212 at a midpoint between the proximate and distal ends 176 and 178 and includes an actuator mounting bore 216 therethrough, as illustrated in FIGS. 2, 3 and 9, the purpose of which will be set out below.

The right-angle track bracket 190 includes horizontal and vertical portions 192 and 194 respectively, formed with a right angle therebetween, having an outer surface 196 and an inner surface 198. The track mount surface 188 of the head spacer bracket 180 is fixed to the outer surface 196 of the track bracket 190 with the track base members 200 fixed to the inner surface 198. As best illustrated in FIG. 7, the track bracket 190 is formed with a width greater than the width of the vertical support 150, such that it extends beyond the first and second sides 166 and 168 and is configured such that the track 174 may be sized to be received within a track guide 218 on the support frame 20, as will be set out below.

Referring to FIGS. 6 through 9, the head support frame 110 includes a planar top mounting bracket 220 at the upper end 152 of the vertical support 150 spaced apart from the rear surface 158 with a bracket spacer 222 therebetween. The bracket spacer 222 is sized to allow the head unit 120 to pass thereby, as will be set out below. The top mounting bracket 220 includes two pairs of mounting holes 224 extending horizontally therethrough to either side 166 and 168 of the vertical support 150, to permit assembly of the tensioning unit 14 for installation on either the first or second side, 26 or 28, of the support frame 20, as will be set out below.

Figure 11:
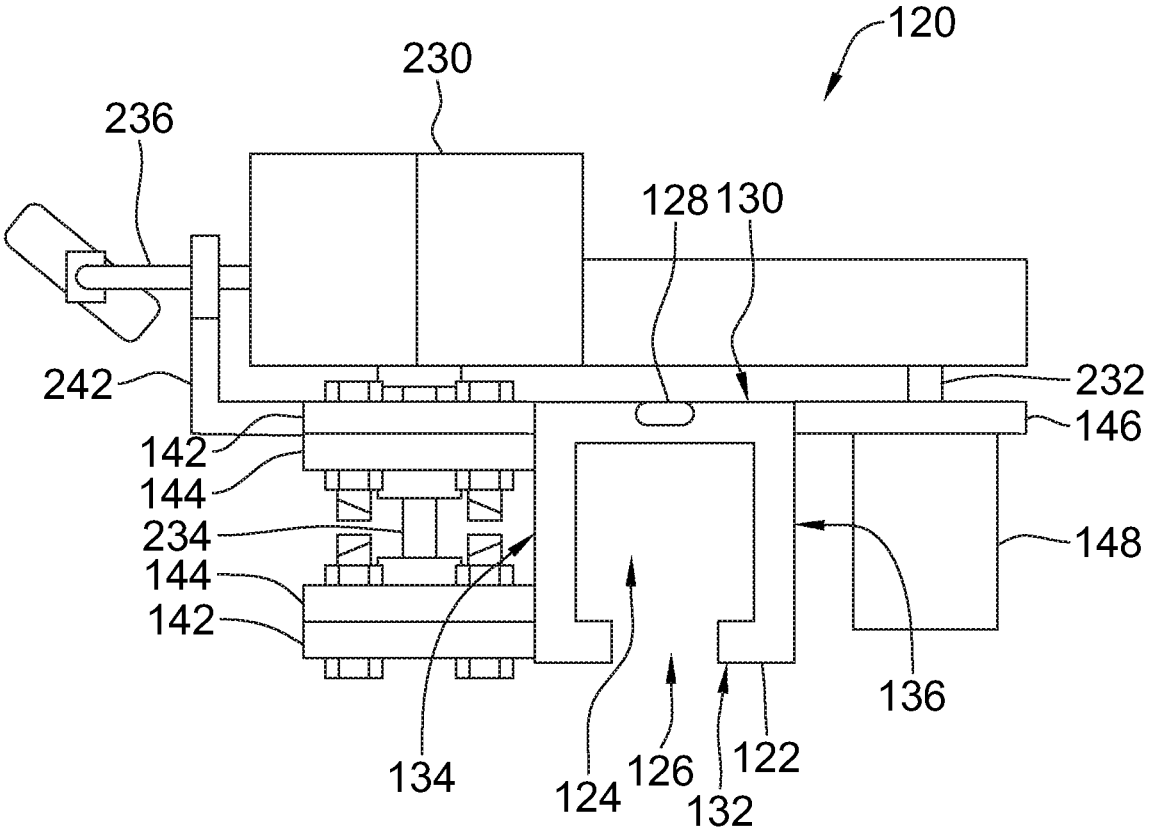
FIG. 11 is a top view of the head unit.

The head unit 120 is configured to be slideably mounted on the head support frame 110. Referring to FIG. 11, the head unit 120 includes a mounting sleeve 122 with a central passage 124 having a generally square cross section sized to receive the vertical support 150 therein with a clearance fit therebetween to permit movement of the head unit 120 over the length of the vertical support 150. The mounting sleeve 122 includes front, rear, first side and second side surfaces, 130, 132, 134, and 136, respectively, as well as top and bottom edges, 138 and 140, respectively, as illustrated on FIG. 8. A gap 126 through the rear surface 132 of the mounting sleeve 122 is sized to permit the head unit 120 to traverse the vertical support 150 past the bracket spacer 222 at the upper end 152 and the head spacer bracket 180 supporting the track 174. A lift eye 128 extends from the top surface 138 proximate to the front surface 130. A second lift eye 128 may also extend from the bottom surface 140 proximate to the front surface 130 (not shown) to allow for the head unit 120 to be installed with either the top surface 138 or the bottom surface 140 facing towards the head pulley support 160. The head unit 120 may be installed and removed by lifting it past the upper end 152 such that the head pulley support 160 passes therethrough. The purpose of removing the head unit 120 will be set out below.

A pair of first side mounting brackets 142 extend transversely from the first side surface 134 proximate to the front and rear surfaces, 130 and 132, respectively. Each first side mounting bracket 142 includes a plurality of bores therethrough configured to mount a shaft bearing thereon 144. A second side mounting bracket 146 extends transversely from the second side surface 136 proximate to the front surface 130 and includes a plurality of bores therethrough to mount a hydraulic motor 148 thereon, as is commonly known. A tensioning winch unit 230 is operably connected to the hydraulic motor 148 with a drive shaft 232 extending between the hydraulic motor 148 and the tensioning winch unit 230 through a bore in the second side mounting bracket 146. A winch shaft 234 extends from the tensioning winch unit 230 through the first side mounting brackets 142 and shaft bearings 144 as is commonly known. The tensioning winch unit 230 may include a chain or belt drive, as is commonly known, between the drive shaft 232 and the winch shaft 234. The hydraulic motor 148 is operably connected to the drive unit 16.

Turning now to FIGS. 6 and 8, the tensioning winch unit 230 rotationally supports a tensioning cable 236, as is commonly known, with a first end secured thereto and a second end 238 secured to a hook 240. The tensioning cable 238 passes through a cable guide eye 242 extending from the first side mounting bracket 142.

Figure 13:
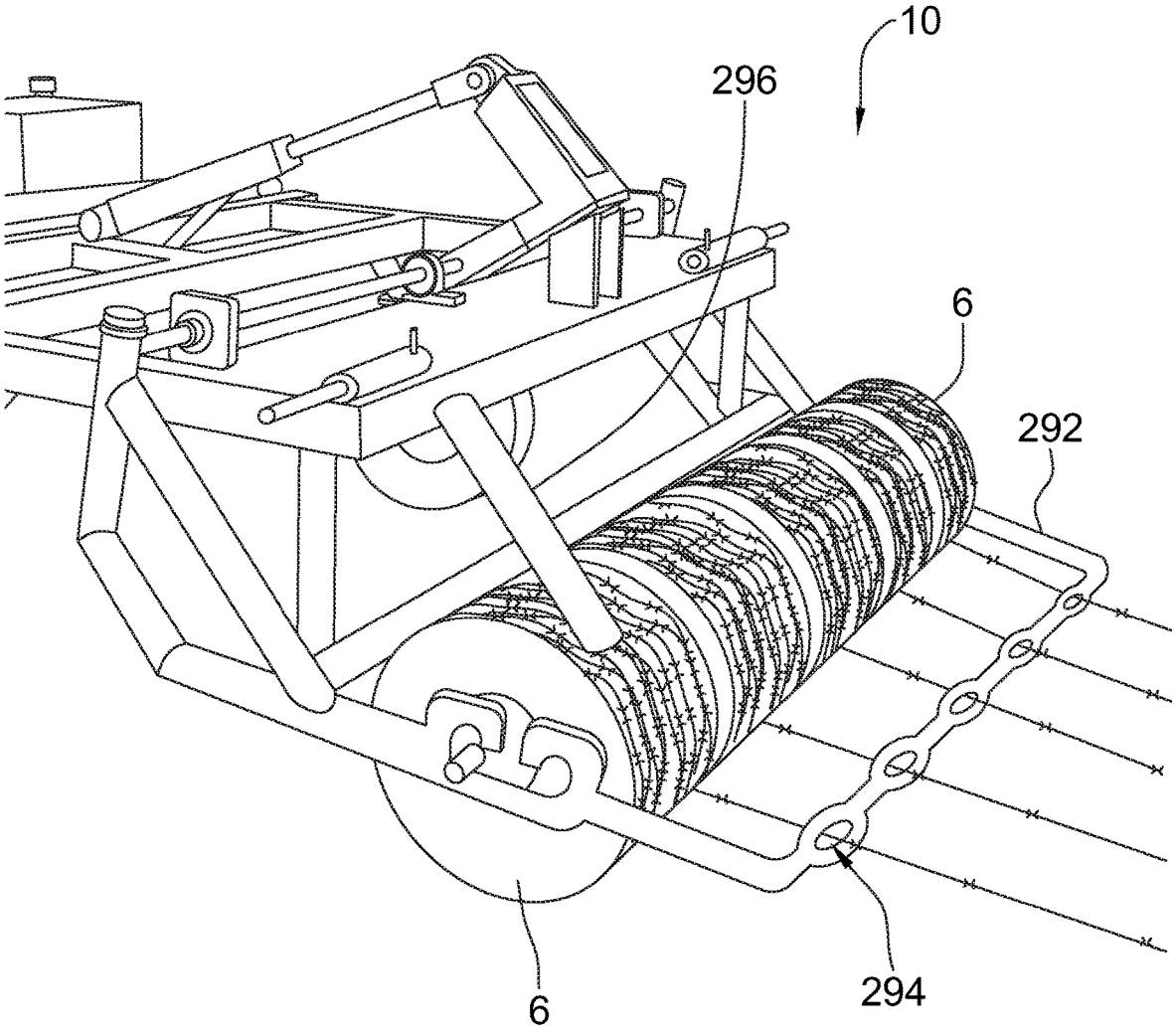
FIG. 13 is a perspective view of the apparatus of FIG. 1 according to a further embodiment of the present invention.

Turning now to FIG. 13, the apparatus 10 may optionally include an extension bar 292 extending around the fence wire wheels 6. The extension bar 292 includes an eyelet 294 for passing each wire therethrough. Furthermore, each fence wire wheel 6 may include a brake bar 296 hingedly connected to the apparatus and positioned so as to lie on each fence wire wheel 6. The brake bar may frictionally engage such fence wire wheel so as to provide a braking force thereto to prevent excessive unwinding of each wheel.

A head support pin 244 includes a shaft portion, as is commonly known, and a larger head portion 246. The shaft portion of the head support pin 244 may be removably received within any of the bores 151, extending between the front surface 156 and the rear surface 158 of the vertical support 150, with the head portion 246 extending transverse to the front surface 156. The head support pin 244 is operably to provide a stop position for the head unit 120 such that the bottom edge 140 of the mounting sleeve 122 engages upon the head portion 246, preventing further downward vertical motion of the head unit 120. The head support pin 244 may be installed in any of the bores 151, adjusting the height at which the tensioning winch unit 230 operates, the purpose of which will be set out below.

Referring to FIGS. 6 through 8, the lift support frame 112 includes an elongate vertical support 250 having a generally square cross section extending between upper and lower ends 252 and 254, respectively, with front and rear surfaces, 256 and 258, respectively and first and second sides 266 and 268, respectively. A lift pulley support 260 is fixed to the front surface 256 and extends from the upper end 252 with a hook 262 thereon supporting a lift pulley 264. The lower end 254 is fixed to a base member 270 having two pairs of mounting holes 272 extending vertically therethrough to either side 266 and 268 of the vertical support 250, to permit assembly of the tensioning unit 14 for installation on either the first or second side, 26 or 28, of the support frame 20, as will be set out below. An elongate horizonal slideable member 274 extends through the vertical support 250 from the front surface 256 and extends transverse to the rear surface 258 of the vertical support 250 between proximate and distal ends, 276 and 278, respectively. A reinforcing sleeve 282 may be fitted onto the vertical support 250 to provide extra reinforcement for the slideable member 274, as best illustrated in FIGS. 1, 6 and 7. A The slideable member 274 is sized and positioned to be received within a sleeve 280 extending from the bottom surface 34 of the support frame 20 transverse to the longitudinal plane 500, as shown in FIG. 1. The sleeve 280 extends between the first and second sides 26 and 28 of the support frame 20 such that the slideable member 274 may be received within the sleeve 280 from either the first or second side 26 or 28 of the support frame 20.

The lift winch 118 is secured to the vertical support 250 proximate to the upper end 252. As best illustrated in FIG. 6, the lift winch 118 rotationally supports a lift cable 288, as is commonly known, with a first end secured thereto and a second end 290 secured to the lift eye 128 on the head unit 120. The lift cable 288 passes through the two lift pulleys 164 and 264, as is commonly known.

As best illustrated in FIG. 9, the lift support frame 112 includes a planar top mounting bracket 284 at the upper end 252 of the vertical support 250 spaced apart from the rear surface 258 with a bracket spacer 286 therebetween. The bracket spacer 286 is sized to correspond with the bracket spacer 222 on the head support frame 110 such that the two top mounting brackets 220 and 284 are aligned. The top mounting bracket 284 includes a pair of mounting holes 288 extending horizontally therethrough, centered over the width of the vertical support 250. The head support frame 110 and lift support frame 112 are joined at the upper ends 152 and 252, respectively, with the upper bracket 114 extending between the two top mounting brackets 220 and 284 and secured thereto with fasteners, as are commonly known. In a first configuration, as illustrated on the Figures herein, the head support frame 110 and lift support frame 112 are joined such that the mounting holes 224 located proximate to the first side 166 are used to secure the upper bracket 114 thereto while the lower bracket 116 is secured to the mounting holes 172 and 272 located proximate to the first side 166 of the vertical support 150 and to the second side 268 of the vertical support 250. In this first configuration, the tensioning unit 14 is configured to be slideably mounted on the first side 26 of the support frame 20. To configure the tensioning unit 14 in a second configuration where the tensioning unit 14 may be slideably mounted on the second side 28 of the support frame 20, the head support frame 110 and lift support frame 112 are joined such that the mounting holes 224 located proximate to the second side 168 are used to secure the upper bracket 114 thereto while the lower bracket 116 is secured to the mounting holes 172 and 272 located proximate to the second side 168 of the vertical support 150 and to the first side 266 of the vertical support 250.

Turning now to FIGS. 2 and 3, the track guide 218 extends between the first and second sides 26 and 28, respectively, and is adapted to receive the track 174 therein to permit a linear sliding motion therebetween. The track guide 218 may include a pair of slots extending between the first and second sides 26 and 28 adapted to receive the track base members 200 therein. At each of the first and second sides, 26 and 28, an actuator mounting bracket 226 extends from the top surface 32. A linear actuator 300 extends between first and second ends, 302 and 304, respectively, and is adapted to be received within the track guide 218 with the first end 302 secured to the actuator mounting bracket 226 on the side of the support frame 20 opposite to the tensioning unit 14. The second end 304 of the linear actuator 300 is secured to the actuator mount 214 on the track 174. The linear actuator 300 is operably connected to the drive unit 16, as is commonly known. The linear actuator 300 may be extended or retracted using the drive unit 16, as is commonly known, in a direction indicated at 506 in FIG. 3. As the linear actuator 300 is extended, the second end 304 moves and the track 174 slides within the track guide 218, while the slideable member 274 slides within the sleeve 280, adjusting the position of the tensioning unit 14 relative to the support frame 20. FIG. 2 illustrates a location of the tensioning unit 14 with the linear actuator 300 retracted, whereas FIG. 3 illustrates a location of the tensioning unit 14 with the linear actuator 300 extended.

To utilize the apparatus 10, a plurality of fence wire reels 6 are rotationally loaded onto the reel support rod 70 with spacers therebetween, as is commonly known. The reel support rod 70 is lifted into place on the reel support 12. The hitch coupler 18 is adjusted to correspond with a vehicle hitch and to the terrain, as is commonly known. A first end of the fence wire 4 is fixed to a fence post, as is commonly known, and the apparatus 10 is drawn forward, thereby dispensing the fence wire 4 from the fence wire reels 6. Depending on the terrain, the reel support 12 may be positioned anywhere between the fully lowered position of FIG. 4 and the fully raised position of FIG. 5 by operating the linear actuator 100 to a suitable extension length.

When the fence wire 4 has been dispensed to the desired length, the apparatus 10 is halted and the tensioning unit 14 is positioned using the linear actuator 300 such that the head support frame 110 is positioned in close proximity to the desired fence run. The lift winch 188 is then manually operated, as is commonly known, to locate the head unit 120 such that it is located above a desired bore 151 and the head support pin 244 is then inserted into the bore 151. The head unit 120 is then lowered, using the lift winch 188, to engage upon the head portion 246 of the head support pin 244, and the lift winch 188 is returned to a brake position.

Figure 12:
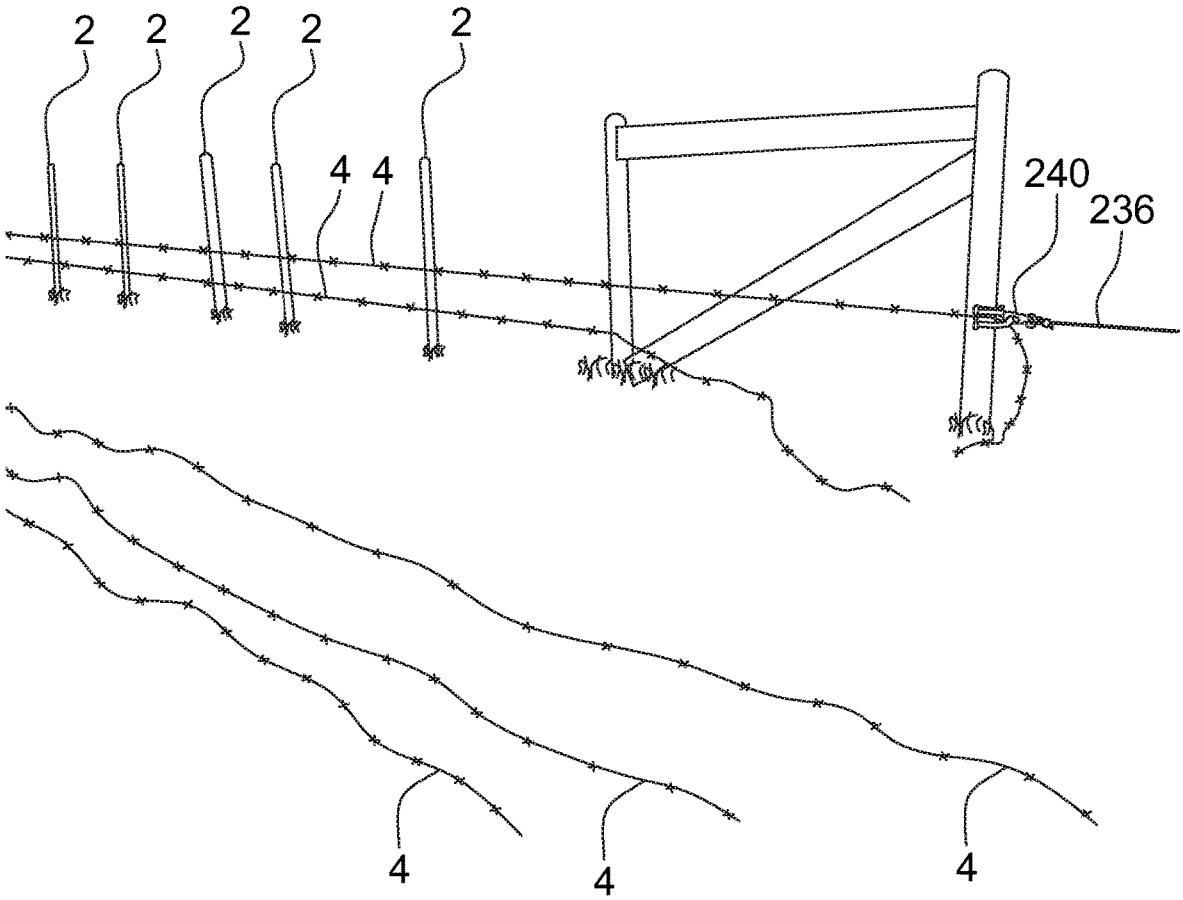
FIG. 12 is a perspective view of a fence with a first wire secured thereon, and with a second wire in tension attached to the tensioning cable.

The tensioning cable 236 is extended from the tensioning winch unit 230 to a desired length, such that the hook 240 is positioned proximate to the fence wire 4. The tensioning cable may be extended by using the controls 66 to operate the hydraulic motor 148, or by manually withdrawing the tensioning cable 236. As illustrated in FIG. 12, the hook 240 is secured to the fence wire 4 by mean as are commonly known, such as, by way of non-limiting example, by connecting with a wire grip, wire dog or clamp secured to the fence wire 4. With the fence wire 4 secured to the hook 240, the hydraulic motor 148 is operated to retract the tensioning cable 236, positioning the fence wire 4 proximate to the fence posts 2 at a height set by the location of the head unit 120 on the head support frame 110, as set out above. The fence wire is then fixed to the fence posts 2, as is commonly known, and the tension in the tensioning cable 236 is released to allow for removal of the hook 240.

Typically, the fence wires 4 are attached to the fence posts 2 starting with the lowest wire and progressing up the fence post to each successive wire. As such, the head unit 120 would typically be initially positioned above the bore 151 proximate to the lower end 154 of the vertical support 150 for the first wire pull, then would be relocated upwards to the next bore 151 for the second pull, and so on, completing the fence wire pull operation with the head unit 120 located above the top bore 151.

While specific embodiments of the invention have been described and illustrated, such embodiments should be considered illustrative of the invention only and not as limiting the invention as construed in accordance with the accompanying claims.

What is claimed is:

1. An apparatus for dispensing and tensioning fence wire, the apparatus comprising:

a support frame supported by wheels and operable to be pulled by a vehicle extending along a longitudinal length between a front and a rear, said frame adapted to be moved along a path proximate to the fence to be formed;

a rotational support adapted to rotatably support at least one reel of fence wire thereon;

an adjustable tensioning unit having an end connector adapted to be selectively secured to a fence wire; and a drive unit wherein said drive unit is adapted draw said end connector towards said support frame so as to apply tension to the fence wire.

2. The apparatus of claim 1 wherein said rotational support includes an elongate shaft extending between distal ends, said elongate shaft adapted to receive at least one reel of fence wire thereon.

3. The apparatus of claim 2 wherein said rotational support is rotatably secured to said frame at a pivot.

4. The apparatus of claim 3 wherein said rotational support is selectively pivotable about said pivot between a raised position and a lowered position.

5. The apparatus of claim 4 further comprising an actuator operable to raise and lower said rotational support.

6. The apparatus of claim 5 wherein said actuator is operably connected to said drive unit.

7. The apparatus of claim 1 wherein said tensioning unit is selectably mountable on one of a first or second side of said support frame.

8. The apparatus of claim 7 wherein said tensioning unit includes a linear actuator operable to selectively position said tensioning unit along a path transverse to said longitudinal length of said frame.

9. The apparatus of claim 8 wherein said linear actuator is operably connected to said drive unit.

10. The apparatus of claim 1 wherein said tensioning unit includes a vertical support having a plurality of bores vertically spaced apart therethrough.

11. The apparatus of claim 10 further comprising a head having a tensioning winch and motor secured thereto, said head slideably supported on said vertical support.

12. The apparatus of claim 11 further comprising a head support adapted to be slideably received within any of said plurality of bores, wherein said head engages upon said head support to be retained at a vertical position on said vertical support corresponding to said head support.

13. The apparatus of claim 11 wherein said tensioning winch is driven by said motor.

14. The apparatus of claim 13 wherein said tensioning winch supports a cable having a first end attached to said tensioning winch and a second end attached to a fastener.

15. The apparatus of claim 14 wherein said fastener is adapted to selectively secure the fence wire thereto.

16. The apparatus of claim 15 wherein said motor rotates said tensioning winch to apply tension to the fence wire secured to said fastener.

17. The apparatus of claim 13 wherein said motor is operably connected to said drive unit.

18. A method for dispensing and tensioning fence wire, the method comprising:

rotatably supporting at least one reel of fence wire on a rotational support extending from a rear of a support frame supported by wheels and operable to be pulled by a vehicle;

securing a first end of the fence wire to one of a plurality of fence posts;

moving said frame along a path proximate to the fence to be formed, dispensing the fence wire along said path;

securing an end connector of an adjustable tensioning unit to a second end of the fence wire, said tensioning unit extending from a side of said support frame;

selectively controlling said tensioning unit with a drive unit to draw said end connector towards said support frame so as to apply tension to the fence wire; and securing a second end of the fence wire to one of said plurality of fence posts.

19. The method of claim 18 further comprising horizontally adjusting a position of the fence wire relative to said plurality of fence posts by adjusting a horizontal position of said tensioning unit relative to said side of said frame with an actuator operably connected to said drive unit.

20. The method of claim 18 further comprising vertically adjusting a height of the fence wire adjacent to said plurality of fence posts by adjusting a vertical position of a tensioning winch on said tensioning unit.

* * * * *